United States Patent [19]

Hukill

[11] Patent Number: 4,469,059

[45] Date of Patent: Sep. 4, 1984

[54] SPARK PLUG

[76] Inventor: Charles A. Hukill, 808 Kewanna Ave., Pittsburgh, Pa. 15234

[21] Appl. No.: 369,188

[22] Filed: Apr. 16, 1982

Related U.S. Application Data

[63] Continuation-in-part of Ser. No. 106,420, Dec. 21, 1979, Pat. No. 4,325,332.

[51] Int. Cl.[3] ..... F02P 13/00

[52] U.S. Cl. ..... 123/169 PA; 123/169 C; 123/169 V; 123/41.32

[58] Field of Search ..... 123/169 R, 169 C, 169 PA, 123/169 V, 260, 585, 41.31, 41.32; 313/120, 11.5, 141

[56] References Cited

U.S. PATENT DOCUMENTS

| | | | |
|---|---|---|---|
| 1,166,385 | 12/1915 | Peck | 123/169 CB |
| 1,286,244 | 12/1918 | Danielson | 313/120 |
| 1,327,382 | 1/1920 | Garber | 313/120 |
| 1,360,561 | 11/1920 | Mueller | 313/120 |
| 1,361,326 | 12/1920 | Hachmann | 313/124 |
| 1,400,524 | 12/1921 | Christern | 313/125 |
| 1,401,799 | 12/1921 | Lester, Jr. | 313/139 |
| 1,410,723 | 3/1922 | Rogers | 313/120 |
| 1,487,659 | 3/1924 | Johnson | 313/127 |
| 1,534,986 | 4/1925 | Natoli | 313/11.5 R |
| 1,661,405 | 3/1928 | Broluska | 123/169 C |
| 1,671,740 | 5/1928 | Phillips | 313/11.5 |
| 1,963,801 | 6/1934 | O'Marra | 123/169 PA |
| 2,028,971 | 1/1936 | Falor | 313/125 |
| 2,034,855 | 3/1936 | Alby | 123/169 PA |
| 2,179,801 | 11/1939 | Smith | 313/124 |
| 2,266,999 | 12/1941 | Smith | 123/169 |
| 2,487,535 | 11/1949 | Fernandez | 313/11.5 |
| 2,605,755 | 8/1952 | Secrist | 313/11.5 |
| 2,658,934 | 11/1953 | Field | 313/120 |
| 2,845,565 | 7/1958 | Peras | 313/131 |
| 3,079,453 | 2/1963 | Clark | 123/169 |
| 3,124,113 | 3/1964 | May et al. | 123/75 |
| 3,204,139 | 8/1965 | Candelise | 123/169 V |
| 3,361,929 | 1/1968 | Vandover | 315/55 |
| 3,958,144 | 5/1976 | Franks | 313/138 |
| 4,015,161 | 3/1977 | Resler | 313/143 |

FOREIGN PATENT DOCUMENTS

| | | | |
|---|---|---|---|
| 2359237 | 6/1975 | Fed. Rep. of Germany . | |
| 2758055 | 6/1979 | Fed. Rep. of Germany | 123/169 C |
| 103051 | 1/1917 | United Kingdom | 313/120 |
| 152270 | 10/1920 | United Kingdom | 313/120 |
| 723726 | 2/1955 | United Kingdom | 123/169 C |

*Primary Examiner*—Ira S. Lazarus
*Assistant Examiner*—R. S. Bailey
*Attorney, Agent, or Firm*—Steele, Gould & Fried

[57] ABSTRACT

A spark plug for igniting air-fuel mixtures, comprising: an elongated annular body with an axial bore; dividing the bore into a valve chamber and a compression chamber; and, a valve disk, slidingly disposed in the valve chamber, the valve disk being subjected to the operating pressure of the cylinder, the valve disk being pressed into a sealing position during compression, ignition and exhaust strokes, and being pulled into an open position during intake strokes, whereby unburned gases enter the combustion chamber during the exhaust strokes and additional air is pulled into the combustion chamber during the intake strokes, the unburned gases and additional air being injected back into the cylinder prior to each ignition to enhance subsequent combustions, the valve disk being substantially immune to damage from the successive shock loading to which it is subjected.

10 Claims, 7 Drawing Figures

FIG. 2
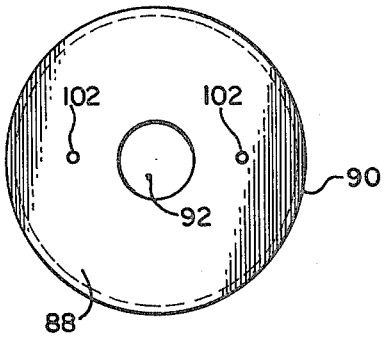
FIG. 3
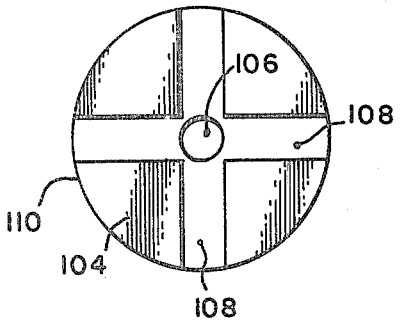
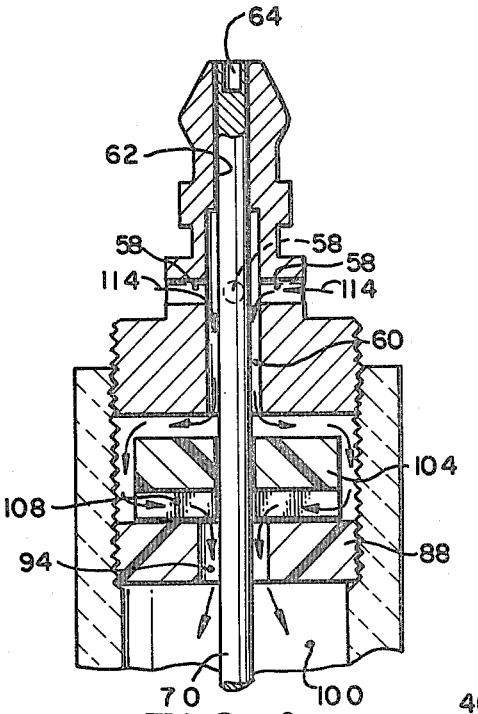
FIG. 4
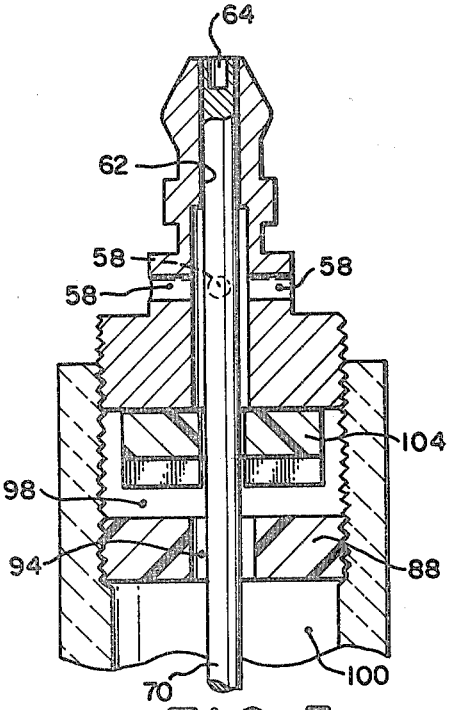
FIG. 5
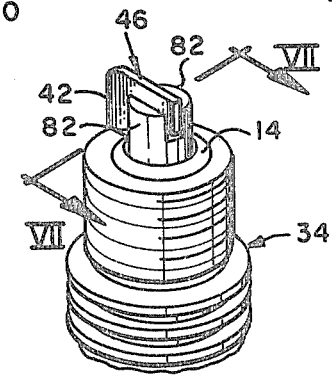
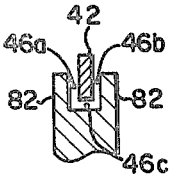
FIG. 7
FIG. 6

SPARK PLUG

CROSS REFERENCES TO RELATED APPLICATIONS

This application is a continuation-in-part of co-pending application Ser. No. 106,420, filed Dec. 21, 1979, and now U.S. Pat. No. 4,325,332. All teachings of co-pending application Ser. No. 106,420 which are not specifically set forth or repeated herein are nevertheless fully incorporated herein by reference.

BACKGROUND OF THE INVENTION

1. Field of the Invention

This invention relates to the field of spark plugs for internal combustion engines in general, and in particular, to a spark plug for injecting additional air and unburned gases from prior combustions into a cylinder prior to each ignition in order to enhance subsequent combustions.

2. Prior Art

In the operation of internal combustion engines, one very significant problem is the inability to effect a complete burning of the air-fuel charge delivered by the carburetor or fuel injectors into the combustion cylinder. It is known that when a vacuum-balancing quantity of any combustion promoting gas, such as oxygen or air, is introduced into the combustion chamber prior to the ignition of the air-fuel charge, a reduction or complete elimination of the need for the piston to act against the progressive vacuum in the cylinder results. The decrease in the amount of energy expended by the piston as a result of the gas injection has at least two positive advantages. Firstly, there is an increase in gas mileage because effective horse power is increased. Secondly, a more complete combustion of the air-fuel mixture reduces the emission of pollutants during the exhaust stroke of the engine. Other advantages can also arise if the engine burns oil or is required to run on a high octane fuel. In the case of the former, oil deposits in the engine will be significantly reduced, and in the latter case, fuel of lower octane may be substituted.

Notwithstanding an appreciation of the advantages to be gained from injecting additional air into the combustion chamber, a significant problem still remained. Regardless of type of device used to inject additional air or oxygen, the back pressure on the valve mechanism, produced during the compression stroke of the engine, is so great that the valve mechanism is quickly damaged by the shock loads to which it is successively and repeatedly subjected. When the valve assemblies break, the integrity of the combustion cylinder is lost and excessive amounts of fuel can leak out of the engine. Even in relative low compression engines such as those being manufactured today, wherein compression ratios are approximately 8:1, no valve mechanism has been available which could withstand the cyclical shock loading. Even arrangements specifically intended to reduce the back pressure, such as ball-valve assemblies, have proved unsatisfactory due to pressure shock and temperature degradation.

One solution to this problem is fully disclosed in my co-pending application Ser. No. 106,420 entitled AIR INJECTION SYSTEM FOR INTERNAL COMBUSTION ENGINES, now U.S. Pat. No. 4,325,332. Such an air injection system for injecting air into a combustion cylinder prior to compression, comprises; air inlet means disposed in the spark plug, the air inlet means including a valve means for metering air into the cylinder; a tube connected to the valve means and extending therefrom through the spark plug, being in communication with the cylinder when the spark plug is mounted in an engine; and, a compression chamber surrounding the tube, substantially occupying the interior of the plug, and in communication only with the tube, gases from prior combustions filling the chamber during exhaust strokes, whereby air and gases from prior combustions are injected into the cyinder prior to ignition, and back pressure shock on the valve means is substantially reduced. The hollow tube also serves as a conducting wire, through the spark plug, for the positive electrode.

Although the air injection system disclosed in my co-pending application solves the problems noted above, the cost and complexity of its construction left room for still further improvement. In the spark plug taught herein, the concept of the hollow positive electrode, surrounded by a compression chamber in fluid communication only with the hollow electrode, has been eliminated. The concept of a very large compression chamber has been maintained. Although a solid positive electrode is utilized herein, it nevertheless serves a dual function, as it served a dual function before, in that it provides a guide means and mounting member for a modified valve disk in a modified valve chamber. A spark plug as taught herein is constructed in a modular form, which can be easily disassembled in order to place any broken or worn parts, should that become necessary.

SUMMARY OF THE INVENTION

It is an object of this invention to provide an improved air-injection system for combustion cylinders.

It is another object of this invention to provide an air-injection system incorporated into a spark plug.

It is still another object of this invention to provide an air-injection system, incorporated into a spark plug, which utilizes a valve assembly to meter additional air into the combustion cylinder.

It is yet another object of this invention to provide an air-injection for metering additional air into a combustion cylinder through a valve assembly which is substantially immune to damage from the successive shock loading to which is subjected by combustion and piston movement in the cylinder.

It is yet another object of this invention to provide a spark plug, incorporating an air-injection system, which is modular in nature, inexpensive to manufacture and easy to repair.

In a presently preferred embodiment, these and other objects are accomplished by a spark plug for igniting air-fuel mixtures, comprising: an elongated annular body, having one tapered end and defining an axial bore of corresponding form, the tapered end having at least one first passageway therethrough; a first cap assembly overfitting the tapered end of the annular bore and defining a first channel between the at least one first passageway and a combustion cylinder into which the spark plug is mountable, the first cap assembly bearing a first electrode projecting into the combustion cylinder; a second cap assembly closing the other end of the annular body and having at least one second passageway through which additional air can flow into the axial bore; an axially disposed electrical conducting member, having one end connected to the second cap assembly, extending through the bore, passing through and closing the tapered end and forming a second electrode, the first and second electrodes together defining a spark gap; a stop member disposed in the bore and closely spaced from the second cap assembly, dividing the bore into a valve chamber between the stop member and the second cap assembly, and a compression chamber, the stop member having an opening which defines a second channel being between the stop member and the conducting member; and, a valve disk, slidingly disposed on the electrical conducting member, in the valve chamber, the valve disk having a smaller diameter than the valve chamber and having at least one third passageway communicating between the outer circumferential wall of the valve disk and the surface thereof facing the stop member, the other surface thereof being flat, the valve disk being subjected to the operating pressure of the cylinder through the first channel, the at least one first passageway, the combustion chamber and the second channel, the valve disk being pressed into a sealing position against the second cap assembly during compression, ignition and exhaust strokes, and being pulled into an open position, against the stop member, during intake strokes, whereby unburned gases enter the combustion chamber during the exhaust strokes and additional air is pulled into the combustion chamber during the intake strokes, the unburned gases and additional air together being injected back into the cylinder prior to each ignition, the valve disk being substantially immune to damage from the successive shock loading to which it is subjected.

BRIEF DESCRIPTION OF THE DRAWINGS

For the purpose of illustrating the invention, there are shown in the drawing forms which are presently preferred; it being understood, however, that this invention is not limited to the precise arrangements and instrumentalities shown.

FIG. 2 is a top plan view of the stop member shown in FIG. 1;

FIG. 3 is a bottom plan view of the disk valve shown in FIG. 1;

FIG. 4 is a cross-section view of the valve assembly shown in FIG. 1, in a fully open condition;

FIG. 5 is a cross-section view of the valve assembly shown in FIG. 1, in a fully closed condition;

FIG. 6 is a perspective view of the electrode spark gap configuration; and,

FIG. 7 is a partial view, in section, taken along the line VII—VII in FIG. 6.

DETAILED DESCRIPTION OF THE PREFERRED EMBODIMENTS

Figure 1:
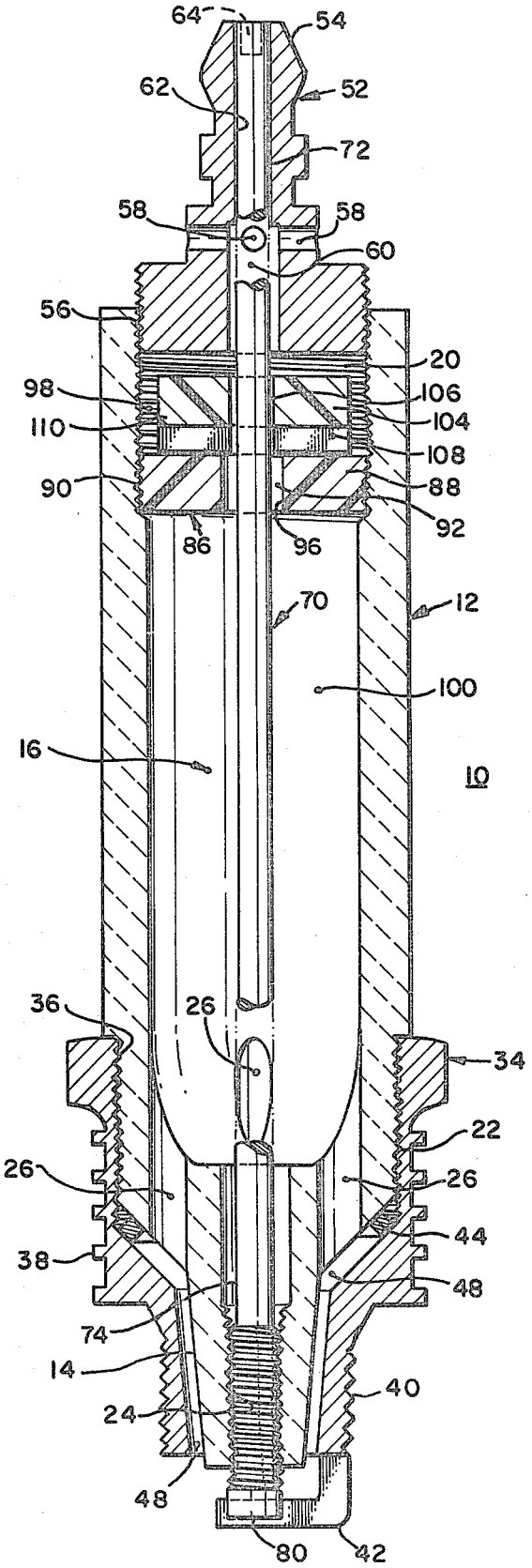
FIG. 1 is a cross-section view, in side elevation, through the center of a spark plug according to this invention.

A spark plug according to this invention is shown in FIG. 1 and generally designated 10. Spark plugs according to this invention are used to ignite changes of an air-fuel mixture in a combustion cylinder. The spark plug 10 comprises five principal components or assemblies. These are the annular body 12, the negative electrode cap assembly 34, the positive electrode cap assembly 52, the electrical conducting member 70, and the valve assembly 86. Interaction of the various components and assemblies permits unburned fuel to be stored in a compression chamber within the spark plug, where it can be mixed with additional air, the mixture then being injected back into the combustion cylinder prior to ignition. This arrangement increases the efficiency of the engine in which such spark plugs are mounted to the extent that increased gas mileage and power result. The spark 10 is of equivalent size to existing "typical" spark plugs, and may be easily substituted in their place. Although FIG. 1 is not drawn precisely to scale, for reasons of facilitating the description, it is shown approximately three times actual size. Spark plugs according to this invention can be manufactured in the wide variety of sizes necessary to accommodate the large variety of internal combustion engines with which spark plugs are used, the principal use being directed to automobile engines.

The annular body 12 is elongated and has a tapered end 14. The elongated annular body 12 defines an axial bore 16 of corresponding form. The tapered end 14 of the annular body 12 is provided with at least one longitudinal bore 26, providing at least one first passageway communicating between the axial bore 16 and the exterior of the annular body. In the presently preferred embodiment there are provided four such first passageways, three of which may be seen FIG. 1. The longitudinal bores 26 are shown as having axes which are substantially parallel to the central axis of the elongated annular body. These axis may be directed inwardly at a small angle, such as approximately 5°, to avoid interfering with the side wall of the annular body. Accordingly, the openings presented at each end of the longitudinal bores 26 are slot-shaped.

The annular body 12 is provided with three threaded portions. A first threaded portion 20 is at the wider end of the body, along the inner surface thereof. A second threaded portion 22 is spaced somewhat inwardly from the tapered end of the annular body, and is provided on the outer surface thereof. A third threaded portion 24 is on the inner surface of the annular body, at the tapered end 14.

A first cap assembly, designated as the negative electrode cap assembly 34 in the presently preferred embodiment, is attached to the annular body 12 by means of a threaded section 36 on the inner surface thereof. This threaded engagement is preferably sealed by a high temperature resistant epoxy. In many respects, the negative electrode cap assembly 34 is similar in construction and appearance to "typical" negative electrode cap assemblies. It is provided with heat dissipation fins 38 and a threaded section 40 by means of which the spark plug 10 may be mounted in an engine block. An electrode 42 projects downwardly from the narrower insertion end of the negative electrode cap assembly and is bent over to form one part of a spark gap 46. The negative electrode cap assembly differs from a typical cap assembly in that the inner diameter of its lower portion is sufficiently large to define a first annular channel 48 between the negative electrode cap assembly and the outer surface of tapered end 14 of the annular body 12. The channel clearance, approximately 1/50 of an inch (0.02 inches), is maintained by a copper gasket 44 of like thickness. The longitudinal bores 26 are so positioned as to be in communication with the channel 48. The tip of the tapered end of the annular body extends beyond the negative electrode cap assembly by approximately 3/32 of an inch (0.094 inches).

A second cap assembly, denoted the positive electrode cap assembly 52 in the presently preferred embodiment, is attached to the wider end of the annular body 12. The uppermost portion of the positive electrode cap assembly is formed into a connecting jack 54 which is shaped to receive a wire connection from a distributor or the like. The positive electrode cap assembly is provided with a threaded portion 56, which engages the first threaded portion 20 of the annular body 12. This interengagement is preferably provided with a fine thread, and may also be sealed with epoxy, or the like. The positive electrode cap assembly is provided with at least one second passageway through which additional air, or any other combustion promoting gas or vapor, can flow from outside of the spark plug, and outside of the engine, into the axial bore, without the first passing through a carburetor or the like. In the presently preferred embodiment, the at least one second passageway comprises two lateral bores 58 which are at right angles to one another and whch intersect at their centers, together with an axial bore 60 which communicates between lateral bores 58 and the axial bore 16 of the annular body 12. The positive electrode cap assembly is also provided with a cylindrical bore 62. The axial bore 60 is of a larger diameter, and the axial bore 62 is of a smaller diameter, with respect to one another.

An electrical conducting member in the form of an axial wire 70 has an upper end 72 fitted into the narrower axial bore 62 of the positive electrode cap assembly 52. Upper end 72 is provided with a bore 64 defining a tubular section approximately 3/64 of an inch (0.047 inches) in diameter and approximately ⅛ of an inch (0.125 inches) deep. The diameter of the narrower axial bore 62 is the same as that of the conducting member 70, whch is such as will just permit upper end 72 to be pushed therethrough. After being positioned, the walls of the tubular section can be spun and expanded, firmly locking the positive electrode cap assembly and electrode together, and ensuring good electrical contact. The electrical conducting member 70 extends through the axial bore 16, passing through and closing the tapered end 14 of the annular body. The lower end 74 of the conducting member 70 is provided with a threaded portion 76, of increased diameter, which engages the third threaded portion 24 of the annular body 12. The portion of lower end 76 which projects beyond the tapered end of the annular body forms an electrode 80 having electrode projections 82. The electrode projections 82 define the spark gap 46 together with the electrode 42. This configuration provides a triple spark gap which can be seen more clearly in FIGS. 6 and 7. The three areas of spark activity are marked **46*a*, 46*b* and 46*c*. In the spark gap, electrode 42** is rotated 180° with respect to ordinary electrodes, its major axis, in cross-section, being aligned with the central axis of the spark plug. Such a configuration promotes more complete combustion of the air-fuel charge.

A valve assembly 86 is formed in the wider end of the axial bore 16, adjacent the positive electrode cap assembly and in the vicinity of the first threaded portion 20 of the annular body. A stop member, in the form of a flattened ring 88 is provided with a threaded portion 90 on its perimeter which engages the first threaded portion 20 of the annular body 12. The stop member 88 is provided with an axial bore 92 of sufficient diameter to define a second channel between the inner circumferential wall 96 of the stop member and the conducting member 70. The stop member 88 divides the axial bore 16 into a valve chamber 98 and a compression chamber 100. As shown in FIG. 2, stop member 88 can be provided with at least two depressions 102 for receiving the prongs of a tool which can be used to rotate stop member 88 within the annular body 12, and thereby adjust its axial position. A valve disk 104 is slidingly disposed on the electrical conducting member 70, within the valve chamber 100. The valve disk is provided with an axial bore 106 which is dimensioned to closely fit around the contacting member 70, so that it may be guided for axial movement with negligible tilting out of a perpendicular orientation with respect to the axis of the valve chamber 98. The diameter of the valve disk is smaller than the inner diameter of the annular member in the vicinity of the valve chamber, so that its outer perimeter 110 is spaced inwardly from the inner wall of the annular member. The valve disk 104 is provided with at least one third passageway communicating between the perimeter wall 110 and the surface of the valve disk facing the stop member 88. The other surface of the valve disk is substantially flat. In the presently preferred embodiment, and with further reference to FIG. 3, the at least one third passageway comprises two channels 108, of rectangular cross-section, which meet at their centers. Both the stop member 88 and the valve disk 104 must be inserted into the annular member 12 prior to attachment of the positive electrode cap assembly 52

The operation of the valve assembly 86 is further illustrated in FIGS. 4 and 5. FIG. 4 illustrates the valve assembly in a fully opened condition and FIG. 5 illustrates the valve assembly in a fully closed condition. The position of the valve disk in FIG. 1 is merely an intermediate position which facilitated the description thereof. It should be noted that the clearances, tolerances and overall axial size of the valve assembly have been exaggerated, also for purposes of facilitating the description. In the presently preferred embodiment, the length of axial travel of the valve disk 104 within the valve chamber is only approximately 1/40 of an inch (0.025 inches). In the presently preferred embodiment, the diameter of the conducting member 70 is approximately 3/32 of an inch (0.94 inches), except for threaded portion 76. The axial length of the valve chamber can be adjusted by rotation of at least one of the stop member 88 and the positive electrode cap assembly 52.

With reference to FIG. 4, when the valve disk 104 is resting against stop member 88, additional air, or another gas or vapor, can enter lateral bores 58, travel through axial bore 60 into valve chamber 98, flow around the perimeter 110 of the valve disk 104, flow through the channels 108 in the valve disk 104 and through channel 94 into compression chamber 100. The air flow is denoted by arrows 114.

With reference to FIG. 5, when valve disk 104 rests or is pressed against the bottom of the positive electrode cap assembly 52, communication between the axial bore 60 and the valve chamber 98 is effectively blocked.

With reference once again to FIG. 1, the compression chamber 100 is also in fluid communication with a combustion cylinder in which the spark plug is mounted, through longitudinal bores 26 and channel 48. This path of fluid communication is always open, as is the channel 94 between the compression chamber and the valve chamber. Accordingly, the valve disk 104 is at all times subjected to the pressure variation in the combustion cylinder. It is in fact the variation in pressure in the combustion cylinder which activates the valve assembly, alternately forcing the valve disk between the open and closed positions. The valve disk is pulled into the open position during the intake stroke or cycle of the engine, and is pushed into the closed position during the compression, ignition and exhaust strokes or cycles. During the exhaust stroke, when the valve assembly is closed, unburned gases from the combustion cylinder are nevertheless forced into the compression chamber 100. During the intake stroke, additional air is pulled into the combustion chamber, where it mixes with the unburned gases of prior combustion. The mixture of unburned gases and additional air is reinjected into the combustion cylinder together with the unburned gases. Reinjection of the "leaned" unburned gases promotes more efficient combustion in subsequent ignition strokes, and increases the overall operating efficiency and power output of the engine.

The manner in which the various components and assemblies of the spark plug are connected to one another provide a modular assembly, which can be easily disassembled in order to replace any broken or worn parts. The cost of replacing such parts is considerably less than the cost of a new spark plug. In fact, such a spark plug may very well last the entire life of an engine, having various portions thereof replaced only as necessary. As in conventional spark plugs, the positive and negative electrode cap assemblies are formed from an electrically conductive metal. The electrically conducting member which extends through the center of the spark plug is preferably made from nickel. The annular body is preferably made from porcelain, as is also typical of existing spark plugs, although the bodies of existing spark plugs do not have large axial bores formed into valve and compression chambers. The threaded portion of the conducting member 70 can be used to adjust the extent to which the electrode 80 projects beyond the tapered of the annular body, in order to adjust the position of the spark gap 46. A cement can be applied to the threads prior to insertion, which will hold the adjustment and seal the joint. The strength of such a cement is sufficient to hold the conducting member in place during operation of the spark plug, but is not so strong that it cannot be broken by the application of sufficient manual pressure of a rotational nature. The setting of a spark gap itself is adjusted by the position of the electrode 42.

As illustrated, the spark plug 10 exhibits a radial symmetry, as do all of its components, except for the depressions 102 of the stop member 88 and the electrode 42 and electrode projections 82.

The relative position of the valve assembly 86 and the compression chamber 100 are such that the valve disk 104 can be precisely and reliably controlled in accordance with the pressure variations in the combustion cylinder, yet at the same time, with assurance that the valve assembly will be substantially immune to damage from the shock loads to which it is continuously and repeatedly subjected. This factor substantially increases the reliability and operating life of the spark plug.

It will be appreciated by those skilled in the art that this invention may be embodied in other specific forms without departing from the spirit of essential attributes thereof, and accordingly, reference should be made to the appended claims, rather than to the foregoing specification, as indicating the scope of the invention.

I claim:

1. A spark plug for igniting air-fuel mixtures, comprising:

an elongated annular body, having one tapered end and defining an axial bore of corresponding form, the tapered end having at least one first passageway therethrough;

a first cap assembly overfitting the tapered end of the annular bore and defining a first channel between the at least one first passageway and a combustion cylinder into which the spark plug is mountable, the first cap assembling bearing a first electrode projecting into the combustion cylinder;

a second cap assembly closing the other end of the annular body and having at least one second passageway through which additional air can flow into the axial bore;

an axially disposed electrical conducting member, having one end connected to the second cap assembly, extending through the bore, passing through and closing the tapered end and forming a second electrode, the first and second electrodes together defining a spark gap;

a stop member disposed in the bore and closely spaced from the second cap assembly, dividing the bore into a valve chamber between the stop member and the second cap assembly, and a compression chamber, the stop member having an opening which defines a second channel between the stop member and the conducting member; and, a valve disk, slidingly disposed on the electrical conducting member, in the valve chamber, the valve disk having a smaller diameter than the valve chamber and having at least one third passageway communicating between the outer circumferential wall of the valve disk and the surface thereof facing the stop member, the other surface thereof being flat, the valve disk being subjected to the operating pressure of the cylinder through the first channel, the at least one first passageway, the combustion chamber and the second channel, the valve disk being pressed into a sealing position against the second cap assembly during compression, ignition and exhaust strokes, and being pulled into an open position, against the stop member, during intake strokes, whereby unburned gases enter the combustion chamber during the exhaust strokes and additional air is pulled into the combustion chamber during the intake strokes, the unburned gases and additional air being together injected back into the cylinder prior to each ignition, the valve disk being substantially immune to damage from the successive shock loading to which it is subjected.

2. The spark plug of claim 1, wherein the first cap assembly comprises a first threaded portion and the annular body comprises a second threaded portion spaced inwardly from the tapered end, the first and second threaded portions being interengagable for connecting the elongated annular body and the first cap assembly one to the other.

3. The spark plug of claims 1 or 2, wherein the second cap assembly comprises a third threaded portion, the inner surface of the annular body adjacent the second cap assembly comprises a fourth threaded portion and the stop member comprises a fifth threaded portion about its outer perimeter, the third and fifth threaded portions interengaging the fourth threaded portion, whereby the stop member is axially positionable for adjusting the size of the valve chamber.

4. The spark plug of claim 3, wherein the inner surface of the tapered end of the annular body comprises a sixth threaded portion and the electrical conducting member comprises a seventh threaded portion, closely spaced from the electrode end of the conducting member, the sixth and seventh threaded portions interengaging one another.

5. The spark plug of claims 1 or 2, wherein the inner surface of the tapered end of the annular body comprises a sixth threaded portion and the electrical conducting member comprises a seventh threaded portion, closely spaced from the electrode end of the conducting member, the sixth and seventh threaded portions interengaging one another.

6. The spark plug of claim 1, wherein the electrical conducting member is a nickel rod having a diameter of approximately 3/32 of an inch, except for a relatively short threaded section closely spaced from the electrode end thereof.

7. The spark plug of claim 1, wherein the stop member is spaced from the second cap assembly a distance necessary to restrict axial movement of the valve disk to approximately 1/40 of an inch.

8. The spark plug of claim 1, wherein the second electrode comprises two electrode projections extending on either side of the first electrode, providing a triple spark gap.

9. A spark plug for ignited air-fuel charges in a combustion cylinder, comprising:

an elongated annular body defining an axial bore and having at least one first passageway therethrough;

first means overfitting one end of the annular body, defining a first channel connecting the at least one first passageway and the cylinder;

second means closing off the other end of the annular body, having at least one second passageway therethrough into the axial bore;

an electrical conducting member extending from the second means, through the axial bore, and out of the annular body, closing off the end of the annular body overfitted by the first means;

third means dividing the axial bore into a valve chamber, adjacent the second means, and a compression chamber, the third means having a second channel communicating between the valve chamber and the compression chamber; and, a valve disk slidingly disposed on the conducting member, in the valve chamber, the valve disk having a smaller diameter than the valve chamber and having at least one third passageway communicating between the outer circumferential wall of the valve disk and the surface thereof facing the stop member, the other surface thereof being flat, the valve disk being subjected to the operating pressure through the cylinder of the first channel, the at least one first passageway, the combustion chamber and the second channel, the valve disk being pressed into a sealing position against the second means during compression, ignition and exhaust strokes, and being pulled into an open position, against the third means, during intake strokes, whereby unburned gases entering the combustion chamber during the exhaust strokes are mixed with additional air pulled into the combustion chamber during the intake strokes, the unburned gases and additional air together being injected back into the cylinder prior to each ignition to enhance subsequent combustions, the valve disk being substantially immune to damage from the successive shock loading to which it is subjected.

10. The spark plug of claim 1, wherein the valve disk comprises at least one lateral channel, of rectangular cross-section, through the surface thereof facing the flattened ring member, the at least one channel of rectangular cross-section forming the at least one third passageway.

* * * * *